US006205822B1

(12) United States Patent
Roell

(10) Patent No.: US 6,205,822 B1
(45) Date of Patent: Mar. 27, 2001

(54) PROCESS FOR JOINING SEVERAL KNITTED FABRICS ON A FLATBED KNITTING MACHINE

(75) Inventor: Friedrich Roell, Biberach (DE)

(73) Assignee: Recaro GmbH & Co., Kirchheim-Teck (DE)

( * ) Notice: Subject to any disclaimer, the term of this patent is extended or adjusted under 35 U.S.C. 154(b) by 0 days.

(21) Appl. No.: 09/171,289

(22) PCT Filed: Apr. 18, 1997

(86) PCT No.: PCT/DE97/00788

§ 371 Date: Mar. 22, 1999

§ 102(e) Date: Mar. 22, 1999

(87) PCT Pub. No.: WO97/40219

PCT Pub. Date: Oct. 30, 1997

(30) Foreign Application Priority Data

Apr. 18, 1996 (DE) ..... 196 16 004

(51) Int. Cl.[7] ..... D04B 7/04
(52) U.S. Cl. ..... 66/64; 66/196
(58) Field of Search ..... 66/176, 172 R, 66/169 R, 169 A, 170, 171, 89, 75.1, 69, 64, 179, 196

(56) References Cited

U.S. PATENT DOCUMENTS 3,581,325 * 6/1971 Betts et al. ..... 66/64
3,702,068 * 11/1972 Betts et al. ..... 66/64
4,691,537 * 9/1987 Cullen et al. ..... 66/64
5,456,096 * 10/1995 Mitsumoto et al. ..... 66/64

FOREIGN PATENT DOCUMENTS 37 25 539 1/1989 (DE) .
39 37 406 5/1991 (DE) .
0 361 855 4/1990 (EP) .
0 711 857 5/1996 (EP) .
2 647 816 12/1990 (FR) .
2 006 288 5/1979 (GB) .
91 04362 4/1991 (WO) .

* cited by examiner

*Primary Examiner*—Danny Wornell
(74) *Attorney, Agent, or Firm*—Smith-Hill and Bedell

(57) ABSTRACT

The present invention relates to a method of joining several knit parts on flat knitting machines.

Figure 1:
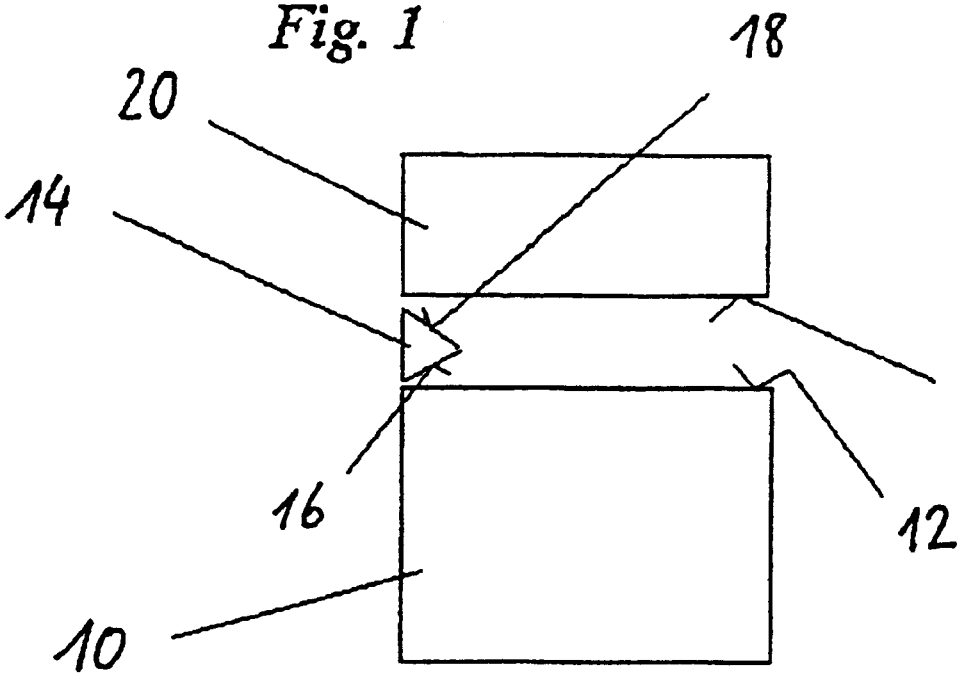

In accordance with the invention several knit parts are produced in sequence or in different areas of the flat knitting machine simultaneously and subsequently joined to each other on differing needle beds by simple attachment knitting or other joining technique for joining loops. When producing two knit parts on a needle bed it is necessary to transfer one knit part to an auxiliary needle bed or a further needle bed and to laterally displace this needle bed so that the desired joining portions may be knitted to each other.

24 Claims, 2 Drawing Sheets

PROCESS FOR JOINING SEVERAL KNITTED FABRICS ON A FLATBED KNITTING MACHINE

Hitherto, various possibilities existed for knitting three-dimensional knits as used e.g. for seat covers. The best possibility consisted of producing cover parts and subsequently stitching the parts to each other. This method has the disadvantage that the parts need to be stitched to each other after production which involves additional costs.

The object of the invention is to provide a method enabling a three-dimensional knit to be produced by as simple means as possible. In accordance with the invention two knit parts are knitted separately on a flat knitting machine and joined to each other at a point, preferably at an edge.

For this purpose the various possibilities in accordance with the invention are available.

In a first embodiment of the invention a first knit part is knitted on the flat knitting machine, The first knit part is knitted such that an edge for joining to another knit part remains hanging on the needles. Subsequently the second knit part is simply knitted in place in the joining portion by the first course in the second knit part being joined to the loops of the first knit part hanging on the needles, whereby only the needles in the joining portion of the two knit parts are activated, the remaining needles on which the first knit part hangs remaining inactive as long as they are joined to a further knit part.

In this way triangular, optionally rectangular, oval or elliptical fashioning parts may be knitted into a knit. Knitting a knit part to the edge of another knit part necessitates as a rule only two knit parts. Working e.g. a triangular fashioning part into a knit necessitates as a rule three knit parts, namely a first knit part, prior to knitting the fashioning part, then knitting the fashioning part and finally knitting the third knit part to a second edge of the fashioning part and to the first knit part. The present method permits joining any number of knit parts in any shape to each other.

It even makes it possibile to join tubular structures to planar knits. For this purpose the planar knit part is knitted as the first knit part. The last course of loops in the planar knit part is joined in the joining portion with the first course knitted on at least two needle beds of the next knit part. Subsequently, the two plies are further knitted separately on both needle beds and rejoined to each other in a last course. In this way a tubular second knit part is knitted to a planar first knit part. This technique may be put to use especially in the production of anchorages, e.g. on car seat covers.

The techniques as cited above may be implemented, of course, in a multi-ply system, necessitating a corresponding number of needle beds in keeping with the number of plies. The above method would require two needle beds for joining planar knit parts in two plies, whereas for joining a planar knit part to a tubular knit part the method as described would already necessitate four needle beds in the region of of the tubular knit part if the tubular knit were two-ply. Correspondingly, six or eight needle beds are needed for three or four plies.

A further method of the present invention necessitates at least one active needle bed and a further active needle bed, auxiliary needle bed or a comb. The first knit part is knitted on a first needle bed of the machine such that the edge for joining the second knit part hangs on the needles after knitting. To this extent this method is the same as the method as described above. Then, however, this knit part is transferred to another needle bed, auxiliary needle bed or a comb.

If a comb is used, it may be guided out of the knit part e.g. by machine action so as not to hinder removal of the knit when knitting the second knit part. This second knit part too, is knitted in such a way that in the end the loops hang on the needles which form the edge for joining the first knit part. This knit part may also be hung by its start and finish loops to the comb, after which it is joined as a tubular structure to the further knit part. Then, these loops hanging on the active needle bed are joined to the displaced loops of the other needle bed, auxiliary needle bed or comb. This may be achieved in various ways. In one way, the loops may be rehung on the active needle bed and further knitted, or the loops may be knitted to each other on a needle bed without being transferred.

In this case too, joining multi-ply knits is possible, the number of needle beds required needing to equal either once or twice the number of knit parts. Working with combs in this case becomes somewhat difficult because likewise several combs need to be provided in the outfeed portion of the knit which afterwards may need to be moved out of the knitting portion and returned back into the knitting portion.

A further method of producing a three-dimensional knit may be briefly termed "drop knitting" or "offset knitting" in which the first knit part is knitted on first needles of a needle bed such that on completion of knitting the edge for joining the second knit part hangs on the needles. These first needles may be e.g. the needles 1,3,5,7 etc, of the needle bed. Then, the second knit part is knitted on the second needles of the needle bed, e.g. on the needles 2,4,8,10 etc. such that in the end the loops forming the edge for joining the first knit part likewise hang on the needles. Then, the loops hanging on both needles can simply be knitted to each other, as a result of which the two knit parts are joined to each other. Using this method even several knit parts may be joined to each other. The first and second needles must not be formed alternatingly by every second needle of the needle bed, any needle pitch may be used depending on the number of knit parts and depending on the desired density of the fabric. For instance, the first needles may be formed by every first, fourth, seventh, tenth etc. needle, whilst the second needles are formed by every second, fifth, eleventh etc. needle. The third, sixth, ninth, twelth needles may be either not activated at all or reserved for a third knit part. In this way it is possible to join knit parts to each other, whose edges differ in length. Thus, e.g. the loops of the first knit part hang on the needles 1,2,4,5,7,8,9,10 etc. whilst the loops of the second knit part hang on the needles 3,6,9,12, etc. In this way two loops each of the first knit part are joined to one loop of the second knit part so that at the joining edge the first knit part has twice as many loops as the second knit part. This is especially of advantage in the production of three-dimensionally shaped parts consisting of several knit parts such as e.g. headrests. The density of the knit may be varied over the needle pitch. This method is suitable especially in producing three-dimensional knits on flat knitting machine equipped with twin needles, the first needles then being formed by the the A needles of the twin needle whilst the second needles are formed by the B needles thereof. For multi-ply knits the number of needle beds needs to correspond to the number of plies. By this method even four-ply knits may thus be produced in technically achievable ways and means when a four-needle bed machine is used. Likewise, tubular knit parts may be produced when the first and last loop course of a knit part is knitted on all needles, whilst the courses inbetween are knitted with only a single needle array, e.g. 1,3,5, etc. It is also possible to knit the knit parts knitted on both needle arrays in synchronism.

In yet a further method in accordance with the invention at least two knit parts are knitted on one needle bed, i.e. the first knit part being knitted in a first portion of the needle bed until it hangs on the needles with the edge for joining the second knit part.

Then, the second knit part is knitted on a portion of the needle bed laterally displaced from the first portion until this knit part too, hangs on the needles by its joining edge. Subsequently, at least one of the knit parts is transferred to a needle bed or auxiliary needle bed and in conclusion hung back correct to loop or, after displacement of the additional needle bed, is knitted with the loops of the other knit part hanging on the other needle bed. This method may of course also be implemented with multi-ply knits, this necessitating, however, twice as many needle beds as knit plies since the transfer action requires a separate needle bed for each ply of a knit part.

The following Figs. illustrate a few examples of various knit parts which may be joined to each other by oom methods of the present invention.

Figure 2:
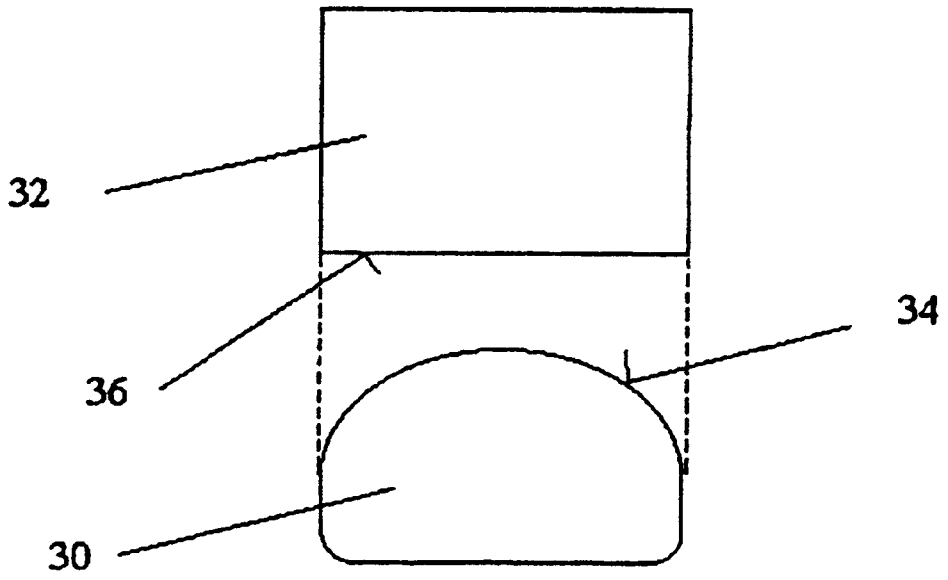
Figure 3:
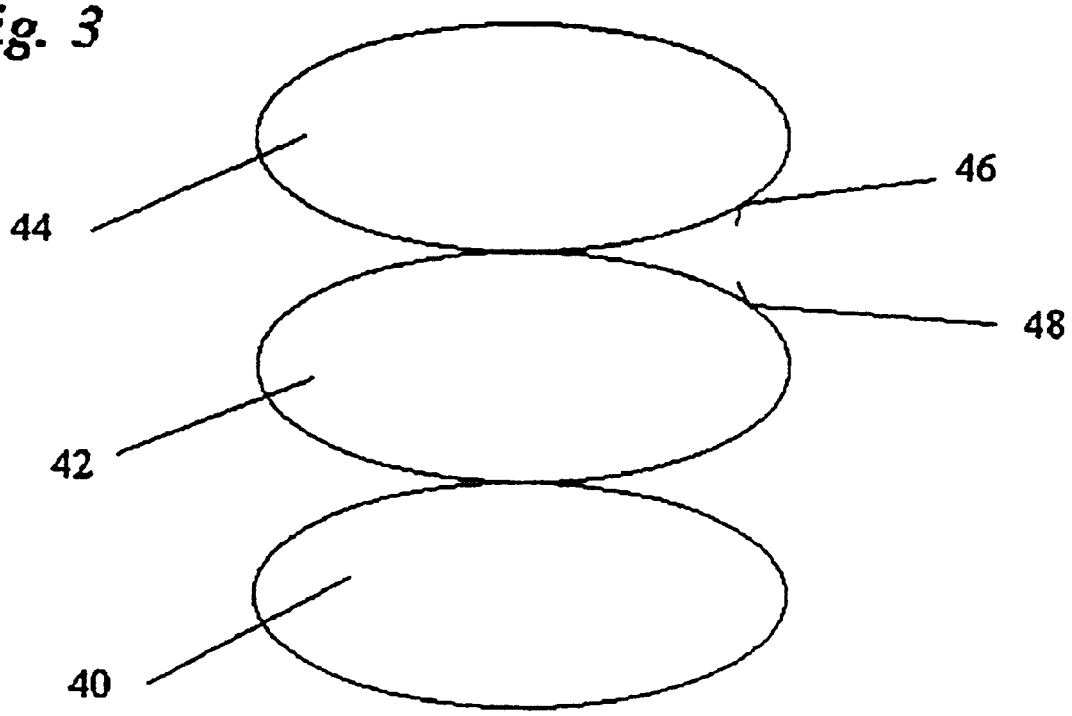

FIG. 1 shows a triangular fashioning part to be inserted between two rectangular knit parts, FIG. 2 shows a rectangular knit part to be joined to a knit part configured in the form of a semi-circular disk, and FIG. 3 shows three ellisoidal knit parts to be joined to each other as may be used e.g. in producing spherical geometries.

Referring now to FIG. 1 there is illustrated a first rectangular knit part 10 which is knitted in the usual way from bottom to top. After knitting the first knit part 10 the loops of the edge 12 hang on the needles of the needle bed. Then, a triangular fashioning part 14 is knitted to the edge 12 of the first knit part 10, the procedure in doing this being as follows. In the first course of the fashioning part 14 which is simultaneously the last course of the first knit part 12, only the first outer link of the fashioning part 14 on the left is joined to the last outer link of the first knit part 10 on the left, the other needles of the needle bed along the edge 12 remaining inactive. Subsequently, in the next course the two or—depending on the staircase steps—three loops of the fashioning part 14 are knitted, each of the two or three outer needles on the left of the needle bed being activated correspondingly. The remaining needles along the edge 12 continue to remain inactive. In the next course three or five needles are then activated etc. until in the end the widest location of the fashioning part is reached. In this state the edge 16 of the fashioning part 14 is totally joined to the outer loops on the left of the edge 12 of the first knit part 10, the loops of the edge 18 of the fashioning part 14 and adjoining on the right the loops of the edge 12 of the first knit part 10 hanging on the needles. Then, over the full width a third knit part 20 is joined with the loops of the edge 18 and 12 already in the first course. The third knit part is then knitted in the conventiional way. It is in this way that in the joining portion between the first and third knit part a bulged portion is generated by the fashioning part 14, this bulged portion resulting in a three-dimensional contouring of the knit. Of course, fashioning parts of any shape in any orientation may be inserted between knit parts. The fashioning parts to be inserted may have, for example, a horizontal edge or may also be irregular in shape.

Referring now to FIG. 2 there is illustrated an example knit in which a first knit part 30 in the form of a semi-circular disk is to be joined to a second rectangular knit part 32. The special feature of this example is that the edges 34 and 36 to be connected to each other comprise a differing number of loops. The edge 34 of the semi-circular disk 30 is substantially longer than the edge 36 of the rectangular second knit part 32. This is why the first knit part 30 is first knitted on every second needle or on two each of three needles etc. in the knitting area of the needle bed until it is only the edge 34 that remains hanging on the needles of the needle bed. Then, the second knit part 32 is knitted with every needle in the knitting area so that the differing number of loops may be adapted to each other in the joining portion of the edges 34 and 36. Where a twin needle system is provided, the first knit part 30 may be knitted only with the A and B needles of the twin needles whilst the second knit part 32 would be knitted with all needles. In this way very simple one-part headrest covers may be produced.

Referring now to FIG. 3 there is illustrated an example embodiment having a first. second and third knit part 40, 42, 44, each of which is to be connected to the other in the region of their facing edges 46, 48. The procedure in this case is such that the first knit part 40 is knitted on the knitting machine until the loops of the top edge 48 of the first knit part 40 hang on the needles. Subsequently the second knit part 42 is knitted, whereby knitting is first done with the middle needles before then being done more and more with the outer needles until in conclusion the bottom edge 46 of the second knit part is totally joined to the top edge 48 of the first knit part 40. The procedure for the third knit part is the same, which is joined to the second knit part 42 in the same way as the second knit part 42 is joined to the first knit part 40. In this way an approximately spherical knit shape materializes which may be used as a premold for brake pressure cylinder.

The knit parts 40 to 44 may, of course, also be knitted juxtaposed on the same needle bed until their top edge 48 hangs on the needles. Then, one knit part may be transferred to an auxiliary needle bed or a, more particularly movable, comb and hung on the loops of the other knit part hanging on the needles, permitting two knit parts e.g. 40 and 42 to be joined to each other. This method has the advantage that both knit parts may be produced in synchronism which speeds up the production procedure. Likewise, simultaneously knitting on several needle beds is, of course, possible, as a result of which also several knit parts may be joined to each other. In the example as shown in FIG. 3 it would be necessary in knitting at least one knit part that the starting loops at the bottom edge 46 are hung onto a comb or an auxiliary needle bed so that these loops may be subsequently joined to the loops of the top edge 48 of the third knit part. Joining the starting course to the final course achieves in turn a tubular structure.

The transition courses in the joining portion of two knit parts may be preferably knitted of an elastic material so that inhomogeneities can be concealed in this region.

The above example embdoiments were described relative to a single-ply knit. However, multi-ply knits may be produced by the same technique when the flat knitting machine features the required number of needle beds/combs.

Where technically possible, e.g. in knitting knit parts on differing needle beds or pairs thereof the various knit parts are knitted in synchronism. When several knit parts are knitted on a single needle bed (pair thereof) knitting must be done successively, when required.

What is claimed is:

1. A method of creating a knit structure composed of a planar first knit part and a tubular second knit part employing a flat knitting machine having at least two needle beds, comprising:

knitting the first knit part and leaving loops of at least one edge of the first knit part hanging on needles of the knitting machine, and knitting a first course of the second knit part utilizing the needles on which the loops of the edge of the first knit part are hung, whereby the second knit part is joined to the first knit part, knitting subsequent courses of the second knit part as separate plies using the two needle beds, and reknitting the separate plies to each other.

2. A method of creating a knit structure composed of at least first and second multi-ply knit parts employing a flat knitting machine, comprising:

knitting the first knit part and leaving loops of at least one edge of the first knit part hanging on needles of the knitting machine, and knitting the second knit part, wherein a first course of the second knit part is knit utilizing the needles on which the loops of the edge of the first knit part are hung, whereby the second knit part is joined to the first knit part, and wherein the knitting machine has a number of needle beds equal to two times the number of plies of the second knit part.

3. A method of creating a knit structure composed of a first knit part and a second knit part employing a flat knitting machine, comprising:

knitting the first knit part on a first portion of a needle bed of the knitting machine and leaving loops of at least one edge of the first knit part hanging on needles of the first portion of the needle bed, knitting the second knit part on a second portion of the needle bed and leaving loops of at least one edge of the second knit part hanging on needles of the second portion of the needle bed, removing one of the first and second knit parts from its portion of the needle bed and transferring said one knit part to the portion of the needle bed on which the loops of the other knit part are hung, and knitting the loops of the first and second knit parts together, whereby the second knit part is joined to the first knit part.

4. A method according to claim 3, comprising transferring said one knit part from its portion of the needle bed to an auxiliary needle bed and then transferring said one knit part from the auxiliary needle bed to the portion of the needle bed on which the loops of said other knit part are hung.

5. A method of creating a knit structure composed of at least first and second knit parts employing a flat knitting machine having at least a first needle bed, comprising:

(a) knitting the first knit part on the first needle bed, the first knit part having loops of a joining edge hanging on the needles of the first needle bed, (b) either (i) transferring the first knit part to a comb or an auxiliary needle bed, or (ii) leaving the first knit part on the first needle bed, (c) subsequently knitting the second knit part on the first needle bed or the auxiliary needle bed and leaving loops of a joining edge of the second knit part hanging on the needles of the needle bed on which the second knit part is knit, and either hanging the loops of the joining edge of the first knit part and the loops of the joining edge of the second knit part on the needles of the first needle bed or the auxiliary needle bed and knitting them together or knitting the loops of the joining edge of the first knit part and the loops of the joining edge of the second knit part to each other using a double-ply knitting technique.

6. A method according to claim 5, wherein step (b) comprises transferring the first knit part to a comb or an auxiliary needle bed and hanging the first knit part on the auxiliary needle bed or on the comb by its starting or final loops.

7. A method according to claim 5, wherein step (b) comprises transferring the first knit part to a comb and the method further comprises removing the comb from the knitting area after hanging the loops of the first knit part and returning the comb into the knitting area prior to joining the knit parts.

8. A method according to claim 5, wherein the first and second knit parts are multi-ply and the number of needle beds of the knitting machine is equal to the number of knit parts multiplied by the number of plies of the knit.

9. A method according to claim 5, comprising knitting the first knit part on a first portion of the first needle bed and knitting the second knit part on a second portion of the first needle bed.

10. A method according to claim 9, further comprising removing one of the first and second knit parts from its portion of the first needle bed and transferring said one knit part to the portion of the first needle bed on which the loops of the other knit part are hung, and knitting the loops of the first and second knit parts together.

11. A method of creating a knit structure composed of first and second multi-ply knit parts on a flat knitting machine having a needle bed with first and second interspersed sets of needles, with at least one needle of the first set between two needles of the second set and at least one needle of the second set between two needles of the second set, said method comprising:

knitting the first knit part on the first set of needles such that a joining edge of the first knit part hangs on the needles after knitting, deactivating the needles of the first set, while the needles of the first set remain inactive, knitting the second knit part on the second set of needles such that a joining edge of the second knit part hangs on the needles after knitting, and thereafter continuing knitting with the first and second sets of needles, and wherein the number of needle beds of the knitting machine is equal to the number of knit parts multiplied by the number of plies of the knit.

12. A method of creating a knit structure on a flat knitting machine having a needle bed with first and second interspersed sets of needles, with at least one needle of the first set between two needles of the second set and at least one needle of the second set between two needles of the second set, said method comprising:

knitting a first knit part on the first set of needles such that a joining edge of the first knit part hangs on the needles after knitting, deactivating the needles of the first set, while the needles of the first set remain inactive, knitting a second knit part on the second set of needles in a first portion of the needle bed such that a joining edge of the second knit part hangs on the needles after knitting and knitting a third knit part on the second set of needles in a second portion of the needle bed such that a joining edge of the third knit part hangs on the needles after knitting, and thereafter continuing knitting with the first and second sets of needles.

13. A method according to claim 12, wherein the needles of the second set in the first portion of the needle bed are interspersed with the needles of the second set in the second portion of the needle bed.

14. A method of creating a knit structure composed of first and second knit parts on a twin-needle flat knitting machine having a needle bed with first and second interspersed sets of needles, with at least one needle of the first set between two needles of the second set and at least one needle of the second set between two needles of the second set, said method comprising:

knitting the first knit part on the first set of needles such that a joining edge of the first knit part hangs on the needles after knitting, deactivating the needles of the first set, while the needles of the first set remain inactive, knitting the second knit part on the second set of needles such that a joining edge of the second knit part hangs on the needles after knitting, and thereafter continuing knitting with the first and second sets of needles, and wherein the first and second sets of needles are the A and B needles of the twin needle knitting machine.

15. A method of creating a knit structure on a flat knitting machine having a needle bed with first and second sets of needles, comprising:

(a) knitting a first multi-ply knit part on the first set of needles such that a joining edge of the first knit part hangs on the needles after knitting, the joining edge of the first part having a first number of loops, (b) knitting a second multi-ply knit part on the second set of needles such that a joining edge of the second knit part hangs on the needles after knitting, the joining edge of the second part having a second number of loops, different from the first number of loops, and (c) knitting the joining edges of the first and second knit parts together, and wherein the number of needles used in step (c) to knit the joining edge having the greater number of loops is equal to the number of loops in the joining edge having the smaller number of loops, and wherein the number of needle beds of the knitting machine is equal to two times the number of plies of the knit.

16. A method of creating a knit structure on a flat knitting machine having a needle bed with first and second sets of needles, comprising:

(a) knitting a first knit part on the first set of needles in a first portion of the needle bed such that a joining edge of the first knit part hangs on the needles after knitting, the joining edge of the first part having a first number of loops, (b) knitting a second knit part on the second set of needles in a second portion of the needle bed such that a joining edge of the second knit part hangs on the needles after knitting, the joining edge of the second part having a second number of loops, different from the first number of loops, and (c) knitting the joining edges of the first and second knit parts together, and wherein the number of needles used in step (c) to knit the joining edge having the greater number of loops is equal to the number of loops in the joining edge having the smaller number of loops.

17. A method of creating a knit structure on a flat knitting machine having a needle bed with first and second sets of needles, with at least one needle of the first set between two needles of the second set and at least one needle of the second set between two needles of the second set, said method comprising:

(a) knitting a first knit part on the first set of needles such that a joining edge of the first knit part hangs on the needles after knitting, the joining edge of the first part having a first number of loops, (b) knitting a second knit part on the second set of needles such that a joining edge of the second knit part hangs on the needles after knitting, the joining edge of the second part having a second number of loops, different from the first number of loops, and (c) knitting the joining edges of the first and second knit parts together, and wherein the number of needles used in step (c) to knit the joining edge having the greater number of loops is equal to the number of loops in the joining edge having the smaller number of loops, and wherein the needles of the first or second set are all the active needles of the needle bed.

18. A method of creating a knit structure on a flat twin needle knitting machine having a needle bed with first and second sets of needles, comprising:

(a) knitting a first knit part on the first set of needles such that a joining edge of the first knit part hangs on the needles after knitting, the joining edge of the first part having a first number of loops, (b) knitting a second knit part on the second set of needles such that a joining edge of the second knit part hangs on the needles after knitting, the joining edge of the second part having a second number of loops, different from the first number of loops, and (c) knitting the joining edges of the first and second knit parts together, and wherein the number of needles used in step (c) to knit the joining edge having the greater number of loops is equal to the number of loops in the joining edge having the smaller number of loops, and wherein the first and second sets of needles are the A and B needles of the twin needle.

19. A method of creating a knit structure composed of at least first and second multi-ply knit parts on a flat knitting machine, comprising:

(a) knitting the first knit part on a first portion of a first needle bed such that the joining edge of the first knit part hangs on the needles after knitting, (b) knitting the second knit part on a second portion of the needle bed such that a joining edge of the second knit part hangs on the needles after knitting, (c) after step (b), transferring loops of the first or second knit part to a further needle bed which is parallel to the first needle bed, (d) displacing the further needle bed relative to the first needle bed in a longitudinal direction of the needle beds, and (e) subsequently knitting the loops of the first and second knit parts to be joined either interlinked or to each other, and wherein the number of needle beds of the knitting machine is equal to the number of knit parts multiplied by the number of plies of the knit.

20. A method according to claim 19, comprising performing step (b) after step (a).

21. A method according to claim 19, comprising performing steps (a) and (b) simultaneously.

22. A method according to claim 19, wherein the joining edge of the second knit part is a starting edge of the second knit part.

23. A method according to claim 22, wherein the joining edge of the second knit part is a finish edge of the second knit part.

24. A method of creating a knit structure on a flat knitting machine having a needle bed with first and second sets of needles, comprising:

knitting a first knit part on the first set of needles in a first part of the needle bed such that a joining edge of the first knit part hangs on the needles after knitting, knitting a second knit part on the second set of needles in a second part of the needle bed such that a joining edge of the second knit part hangs on the needles after knitting, and knitting the joining edges of the first and second knit parts together.

* * * * *